US006150909A

United States Patent [19]

Meier

[11] Patent Number: 6,150,909

[45] Date of Patent: Nov. 21, 2000

[54] ELECTROMAGNETIC SWITCHING DEVICE

[75] Inventor: Markus Meier, Rieden, Germany

[73] Assignee: Siemens Aktiengesellschaft, München, Germany

[21] Appl. No.: 09/403,292

[22] PCT Filed: Apr. 6, 1998

[86] PCT No.: PCT/DE98/00975

§ 371 Date: Oct. 15, 1999

§ 102(e) Date: Oct. 15, 1999

[87] PCT Pub. No.: WO98/48436

PCT Pub. Date: Oct. 29, 1998

[30] Foreign Application Priority Data

Apr. 18, 1997 [DE] Germany ..... 197 16 380

[51] Int. Cl.[7] ..... H01H 67/02; H01H 75/00; H01H 9/00; H01H 3/00

[52] U.S. Cl. ..... 335/132; 335/6; 335/15; 335/129; 335/172; 335/177; 335/178; 335/194

[58] Field of Search ..... 335/6, 15, 16, 335/129, 132, 172, 177, 178, 184, 194, 195

[56] References Cited

U.S. PATENT DOCUMENTS

| | | | |
|---|---|---|---|
| 4,292,611 | 9/1981 | Bresson et al. | 335/6 |
| 4,307,358 | 12/1981 | Haury et al. | 335/6 |
| 4,491,812 | 1/1985 | Happach | 335/184 |
| 5,163,175 | 11/1992 | Mori et al. | 335/132 |

*Primary Examiner*—Lincoln Donovan
*Assistant Examiner*—Ray Barrera
*Attorney, Agent, or Firm*—Kenyon & Kenyon

[57] ABSTRACT

An electromagnetic switchgear unit has an electromagnetic drive appliance which acts as an auxiliary magnet system and by means of which the contact force is first increased on the occurrence of a short-circuit current, before the contacts are abruptly torn apart. For this purpose, the drive appliance actuates a lever rotatably supported on the contact bridge carrier, which lever displaces the contact bridge carrier and, by this means, compresses a contact compression spring and a further compression spring.

3 Claims, 4 Drawing Sheets

ELECTROMAGNETIC SWITCHING DEVICE

FIELD OF THE INVENTION

The present invention relates to an electromagnetic switchgear unit having a pair of fixed contacts, a pair of fixed contact elements on which the fixed contacts are individually fastened, a movable contact element which is acted upon by a contact compression spring and has a pair of movable contacts on it which can be brought into and out of connection with the fixed contacts, a contact bridge carrier on which the movable contact element is held by means of the contact compression spring, a first electromagnetic drive appliance for rapid circuit breaking with a first armature and a coil, which is connected in series with one of the fixed contact elements, and a second electromagnetic drive appliance, with a second armature, for switching the load current on and off.

BACKGROUND INFORMATION

An electromagnetic switchgear unit is described in German Patent No. DE 43 18 196 A1. By means of this electromagnetic switchgear unit, load currents are connected and excessive currents, mainly short-circuit currents, are limited. In this case, the first electromagnetic drive appliance is operated as an auxiliary system which, in the case of excessive currents, exerts a force on the movable contact element and, by this means, opens the contacts. This therefore prevents the contacts being in an undefined floating condition, in which the contacts could become welded, due to electrodynamic forces. Such weld-free contactors are employed in association with a circuit-breaker. For economic reasons, the contactor is usually provided with a circuit-breaking capability which is lower than that of the circuit-breaker. Its current limitation only acts to support the circuit-breaker. It is therefore necessary for the auxiliary magnet system of the contactor to respond at a higher current than that of the circuit-breaker. It is also a requirement that the contacts should, in the case of a short-circuit, be held closed by the main magnet system until they are separated from one another by the auxiliary magnet system of the contactor. In order to satisfy these two requirements, magnet systems are necessary which are larger than those for standard units with the same switching capacity.

SUMMARY OF THE INVENTION

The present invention is based on the object creating an electromagnetic switchgear unit, of in which switch-off in the case of a short circuit takes place in association with improved measures for preventing welding of the contacts.

The object is achieved in accordance with the present invention in that the contact bridge carrier can be displaced in its longitudinal axis relative to the second armature, in that a compression spring engages with the contact bridge carrier, by means of which compression spring the motion of the second armature can be transmitted to the contact bridge carrier for contact opening, in that when the first electromagnetic drive appliance responds, the motion of the first armature is transferred to the contact bridge carrier in such a way that the contact compression spring is compressed in a first phase and, by this means, the contact pressure is increased and, at the same time, the compression spring also stores energy by means of which the contact bridge carrier is pressed, in a second phase, into the direction which causes the contact opening.

DETAILED DESCRIPTION

Figure 1:
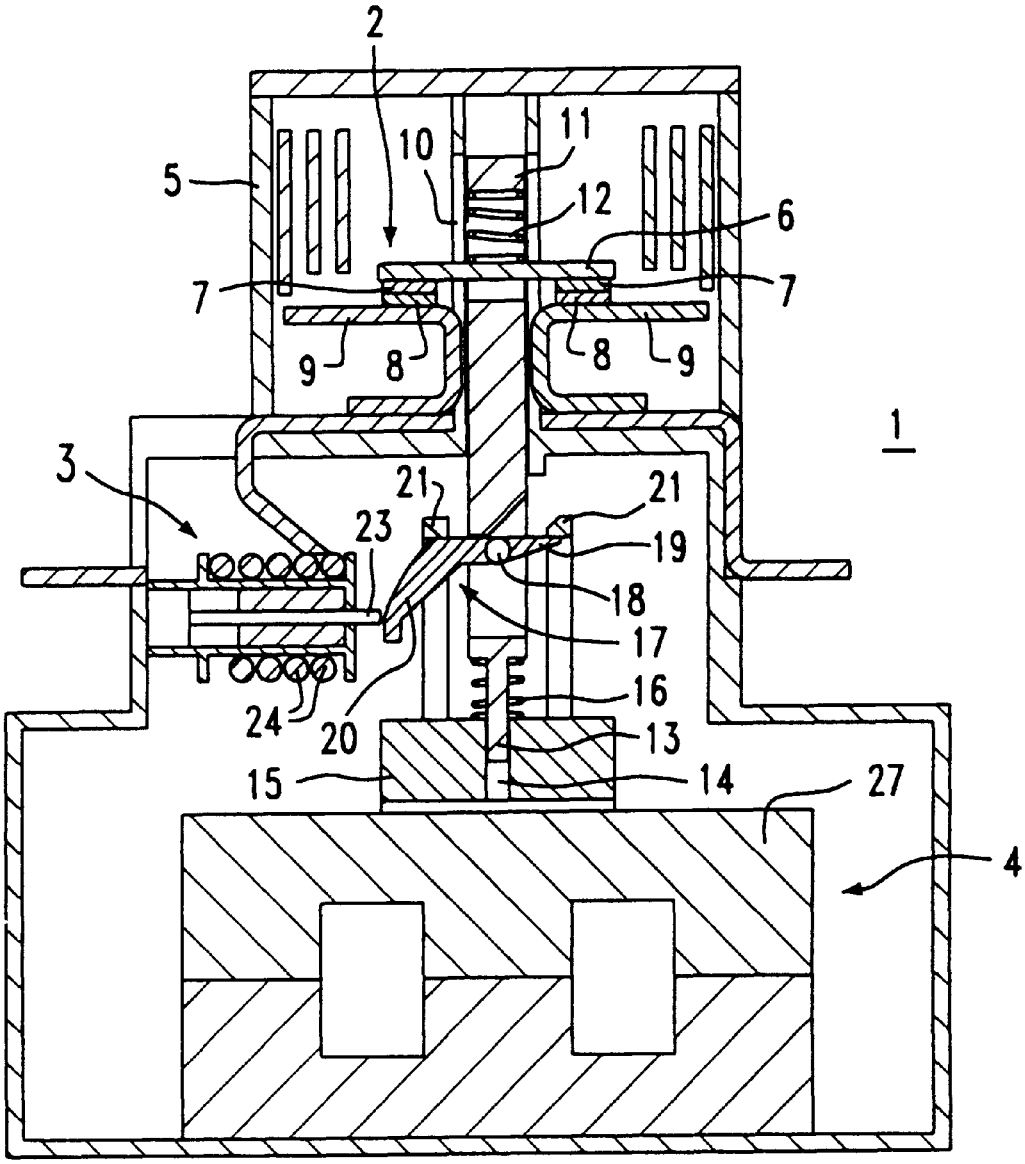
FIG. 1 shows a sectional representation of a switchgear unit according to the present invention in the ON condition and carrying operational current.

FIG. 1 shows an electromagnetic switchgear unit 1 with a contact system 2, a first electromagnetic drive appliance 3 and a second electromagnetic drive appliance 4. The contact system 2 arranged in the electric arc casing 5 comprises a movable contact element 6 with movable contacts 7 on its mutually opposite end regions for providing contact with a pair of fixed contacts 8, which are connected to a pair of fixed contact elements 9. The movable contact element 6 is supported by means of a contact compression spring 12 in a window 10 of a contact bridge carrier 11 guided at its casing end. FIG. 1 shows the electromagnetic switchgear unit 1 in the ON condition, in which the contact bridge carrier 11 is located in the lower position and such that the contact compression spring 12 effects, by means of the moving contact element 6, contact between the moving contacts 7 and the opposite fixed contacts 8. The lower end of the contact bridge carrier 11 is embodied as a pin 13 which is guided in a hole 14 of a contact carrier plate 15. The contact carrier plate 15 is connected to the armature 27 of the second electromagnetic drive appliance 4. By means of the pin 13 in the hole 14, the contact bridge carrier 11 can be displaced axially. The motion in the direction of the drive appliance 4, which is located at the bottom of FIG. 1, acts against a compression spring 16 supported on the contact bridge carrier 11 and the contact carrier plate 15. A lever 17, which acts as a transmission link and whose two arms 19 and 20 are supported on shoulders 21, is rotatably on the contact bridge carrier 11 by means of a pin 18. The first electromagnetic drive appliance 3 is arranged in such a way that when triggered, its armature 23—which is a pressure—actuates the lever 17 anticlockwise. The coil 24 of the first electromagnetic drive appliance 3 is connected in series with one of the fixed contact elements 9. When the appliance is triggered as a consequence of excess currents, in particular short-circuit currents, a force is exerted by the pressure pin 23 of the first electromagnetic drive appliance 3. This force is transferred via the pin 18 in such a way that the contact force is increased with increasing current.

Figure 2:
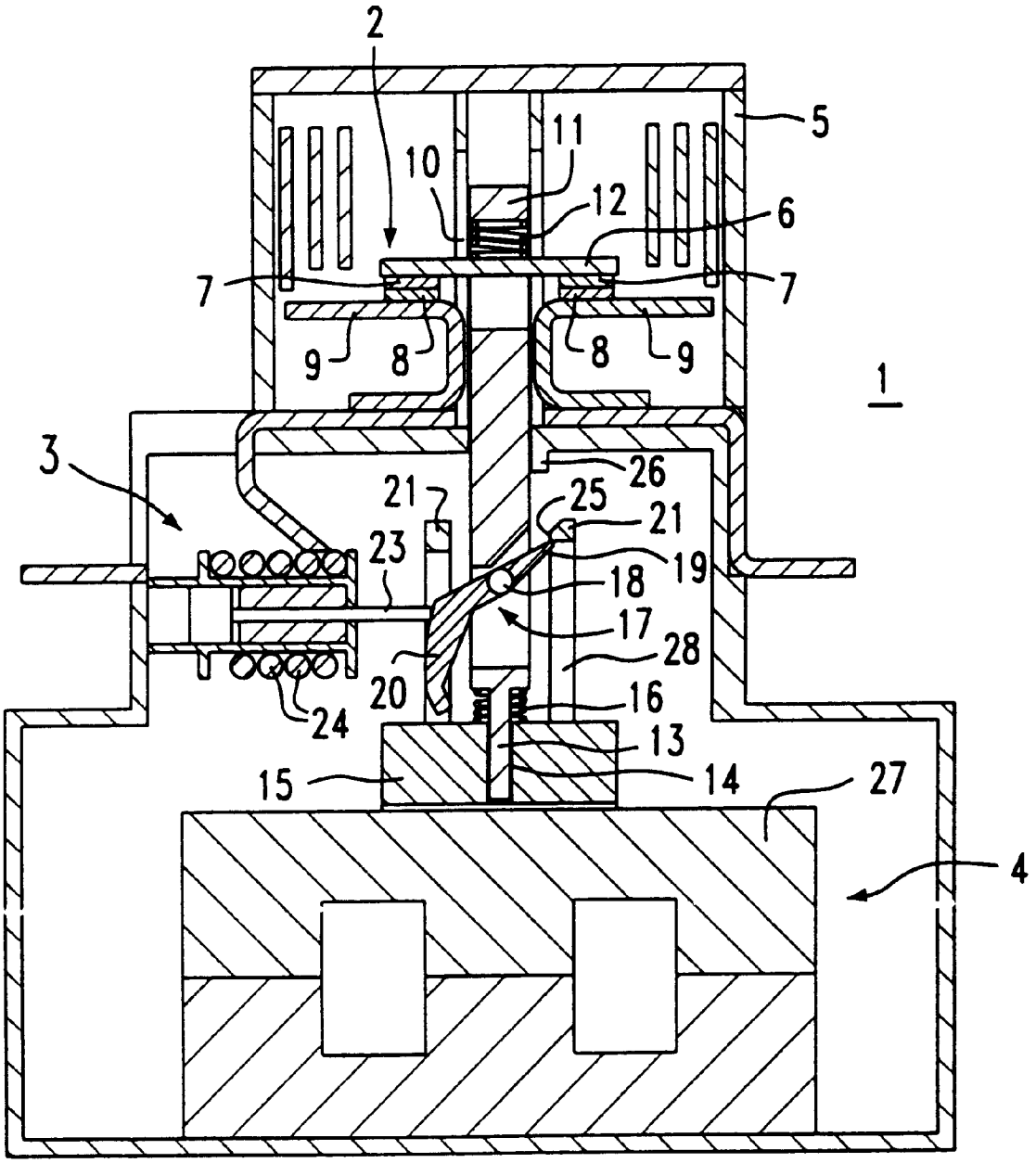
FIG. 2 shows a sectional representation of the switchgear unit of FIG. 1 when a short-circuit current is applied.

When a short-circuit current is applied, the contact bridge carrier 11 is displaced, by means of the pin 18, in the direction of the contact carrier plate 15, one arm 19 of the lever 17 being supported on one shoulder 21 and, at the same time, compression of the contact compression spring 12 and the compression spring 16 takes place (see FIG. 2).

Figure 3:
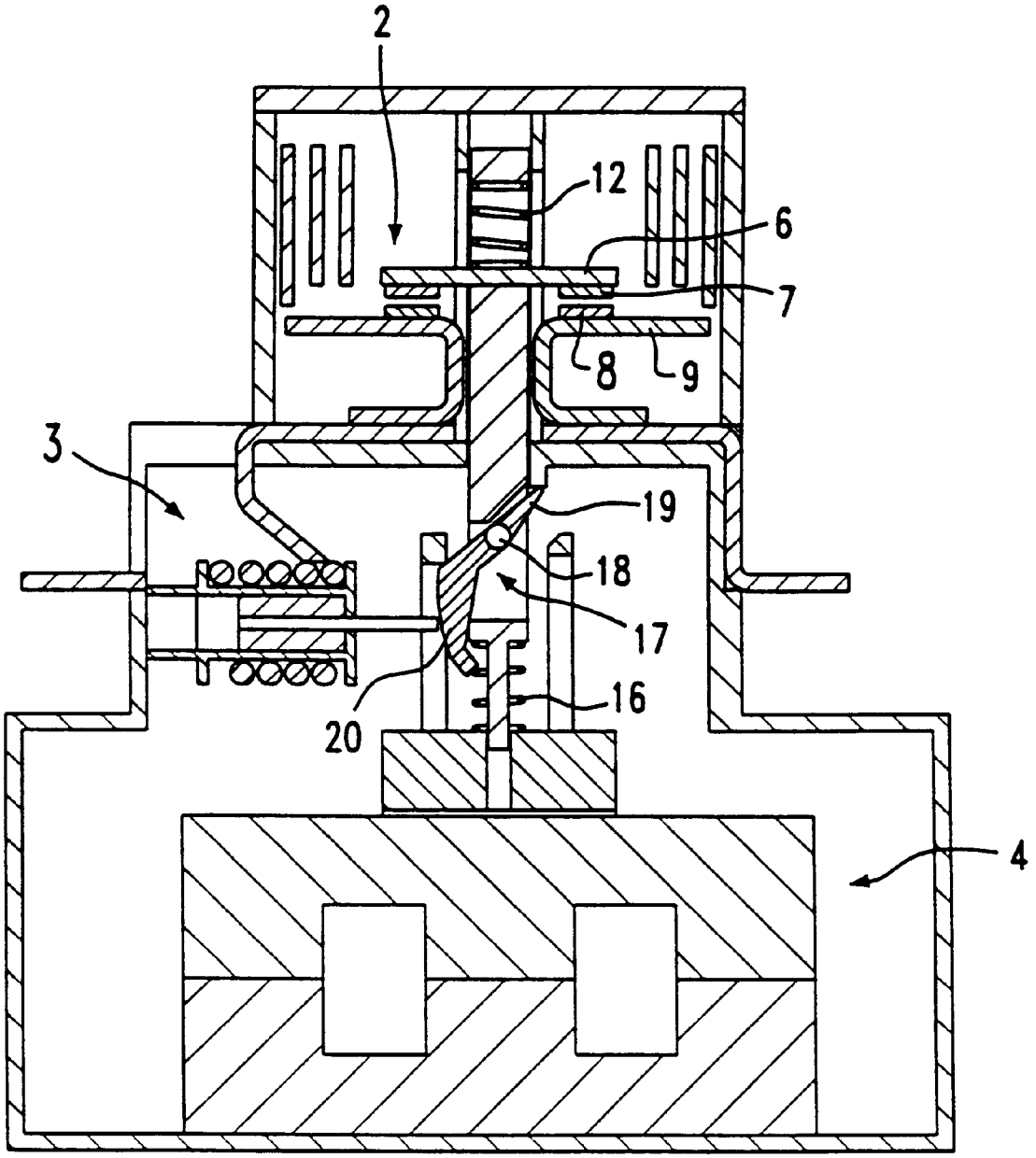
FIG. 3 shows a sectional representation of the switchgear unit according to the present invention as shown in FIG. 1 after the auxiliary magnet system is triggered.

At a certain value of the current, the deflection of the lever 17 becomes so large that it slips over an edge 25 of the shoulder 21. The result of this is that the energy stored in the contact compression spring 12 and in the compression spring 16 effects an abrupt opening of the contacts 7, 8, as is shown in FIG. 3.

Figure 4:
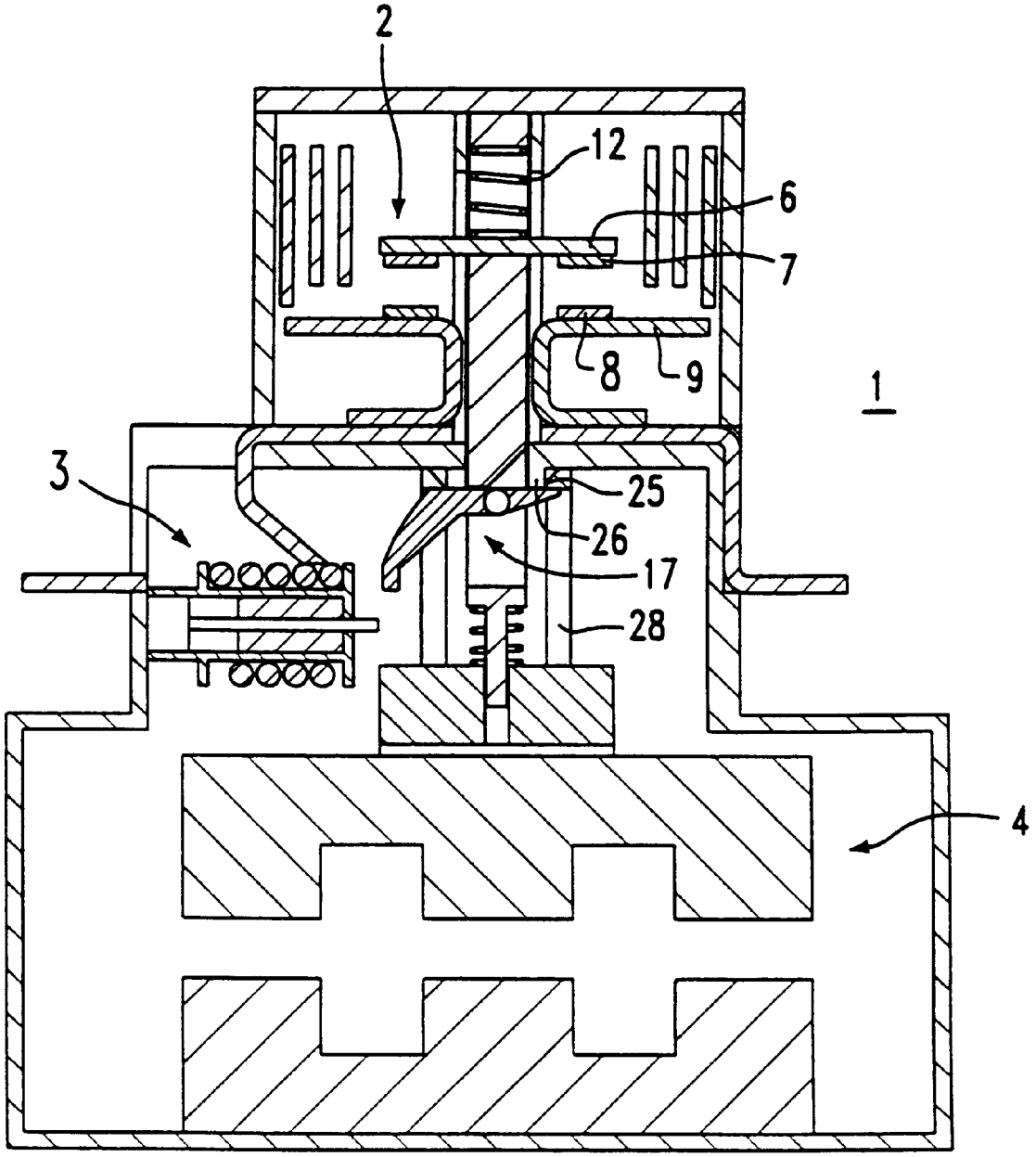
FIG. 4 shows a sectional representation of the switchgear unit according to the present invention of FIG. 1 in the OFF condition.

After the short circuit has been corrected, the switchgear unit 1 is returned to its initial condition, as shown in FIG. 4, by switching off the second electromagnetic drive appliance 4.

In this process, the lever 17 is pressed back over the edge 25 by the return compression spring (not shown here) of the second electromagnetic drive appliance 4 and by a protrusion in the casing 26, the spar 28 provided with the edge 25 being bent laterally out of position.

In a simple manner, the present invention achieves the result that, on the occurrence of a short circuit, the contact pressure is increased in a first phase with the aid of an additional electromagnetic drive appliance 3, energy being stored in the contact compression spring 12 and the compression spring 16. In the subsequent second phase, the energy stored in the springs 12, 16 is used, after the release of the contact bridge carrier 11, in order to open the contacts 7 and 8 abruptly.

Although the present invention is explained with reference to the embodiment represented in the attached drawing, it should be noted that this is not intended to limit the invention exclusively to the embodiment represented but, rather, to include all possible changes, modifications and equivalent arrangements to the extent that they are covered by the contents of the patent claims.

What is claimed is:

1. An electromagnetic switchgear unit, comprising:

two fixed contact elements;

two fixed contacts individually fastened on the two fixed contact elements;

a movable contact element including two movable contacts, the two movable contacts being brought into and out of a connection with the two fixed contacts;

a contact compression spring acting upon the moveable contact element;

a first electromagnetic drive arrangement including a first armature and a coil, the first electromagnetic drive arrangement providing a rapid circuit breaking and being connected in series with one of the two fixed contact elements;

a second electromagnetic drive arrangement including a second armature, the second electromagnetic drive arrangement switching a load current on and off;

a contact bridge carrier having a longitudinal axis, the movable contact element being held on the contact bridge carrier by the contact compression spring, the contact bridge carrier being displaceable in the longitudinal axis relative to the second armature; and a second compression spring acting on the contact bridge carrier, a motion of the second armature being transmitted, via the second compression spring to the contact bridge carrier for contact opening, wherein when the first electromagnetic drive arrangement responds, a motion of the first armature is transferred to the contact bridge carrier so that the contact compression spring is compressed, in a first phase, to increase a contact pressure, and energy stored in the second compression spring is used to press the contact bridge carrier, in a second phase, into a direction which causes the contact opening.

2. The electromagnetic switchgear unit according to claim 1, further comprising:

a transmission element transmitting the motion of the first armature, the transmission element being coupled to the contact bridge carrier.

3. The electromagnetic switchgear unit according to claim 2, wherein the transmission element includes a lever, the lever being rotatably supported on the contact bridge carrier, an arm of the lever being supported in the first phase while rotating and simultaneously driving the contact bridge carrier, the arm being released in the second phase for the contact opening.

* * * * *